US010925338B2

(12) United States Patent
Turner

(10) Patent No.: US 10,925,338 B2
(45) Date of Patent: Feb. 23, 2021

(54) KNIT GARMENT WITH REDUCED SEAMS

(71) Applicant: NIKE, INC., Beaverton, OR (US)

(72) Inventor: David Turner, Beaverton, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 15/903,755

(22) Filed: Feb. 23, 2018

(65) Prior Publication Data

US 2018/0249777 A1 Sep. 6, 2018

Related U.S. Application Data

(60) Provisional application No. 62/465,361, filed on Mar. 1, 2017.

(51) Int. Cl.

| | |
|---|---|
| ***A41D 27/24*** | (2006.01) |
| ***A41D 1/08*** | (2018.01) |
| ***A41D 27/10*** | (2006.01) |
| ***A41D 31/02*** | (2019.01) |
| ***D04B 1/16*** | (2006.01) |

(Continued)

(52) U.S. Cl.

CPC ..... *A41D 27/245* (2013.01); *A41D 1/04* (2013.01); *A41D 1/08* (2013.01); *A41D 27/10* (2013.01); *A41D 31/02* (2013.01); *D04B 1/16* (2013.01); *D04B 1/246* (2013.01); *D04B 21/207* (2013.01); *A41B 2400/20* (2013.01); *A41D 2500/10* (2013.01); *D10B 2201/02* (2013.01); *D10B 2211/02* (2013.01); *D10B 2211/04* (2013.01);

(Continued)

(58) Field of Classification Search

CPC ..... A41D 27/245; A41D 1/04; A41D 1/08; A41D 27/10; A41D 31/02; D04B 1/16; D04B 1/246; D04B 21/207; A41B 2400/20; D10B 2201/02; D10B 2211/02; D10B 2211/04; D10B 2332/04; D10B 2403/011; D10B 2501/00

USPC ..... 2/69

See application file for complete search history.

(56) References Cited

U.S. PATENT DOCUMENTS

| | | | |
|---|---|---|---|
| 1,202,332 | A | 10/1916 | Tschirgi |
| 1,890,385 | A | 12/1932 | Kay |

(Continued)

FOREIGN PATENT DOCUMENTS

| | | | |
|---|---|---|---|
| CN | 101039598 | A | 9/2007 |
| WO | 03042443 | A1 | 5/2003 |

OTHER PUBLICATIONS

"David Telfer: 1 Piece Construction," David Telfer, davidtelfer.co.uk, Aug. 7, 2013.

(Continued)

*Primary Examiner* — Khoa D Huynh
*Assistant Examiner* — Uyen T Nguyen
(74) *Attorney, Agent, or Firm* — Shook, Hardy & Bacon L.L.P.

(57) ABSTRACT

A knit garment comprises a seamless, tubular torso section, a shoulder section knit continuously with the torso section along a front surface, and a single, continuous seam affixing the shoulder section to the torso section along a width of the upper back of the garment. Such a garment can be made by continuously knitting a double-layer web, interlooping the layers of the web to one another to forma central tube, severing the web, trimming material from the first layer of the double layers, folding the second layer over itself toward the first layer, and affixing the second layer to the first layer.

14 Claims, 7 Drawing Sheets

(51) Int. Cl.
*A41D 1/04* (2006.01)
*D04B 21/20* (2006.01)
*D04B 1/24* (2006.01)

(52) U.S. Cl.
CPC .... *D10B 2331/04* (2013.01); *D10B 2403/011* (2013.01); *D10B 2501/00* (2013.01)

(56) References Cited

U.S. PATENT DOCUMENTS

| | | | | | |
|---|---|---|---|---|---|
| 2,072,050 | A * | 2/1937 | Sharps | A41D 1/04 | 2/90 |
| 2,126,186 | A * | 8/1938 | Friedland | A41D 1/04 | 2/90 |
| 2,446,482 | A | 8/1948 | Hudson | | |
| 2,549,894 | A | 4/1951 | Crossingham | | |
| 2,588,606 | A * | 3/1952 | Artzt | A41D 1/04 | 2/113 |
| 3,056,970 | A | 10/1962 | Owen | | |
| 3,195,147 | A | 7/1965 | Kohei | | |
| 3,298,033 | A | 1/1967 | Kohei | | |
| 3,561,009 | A | 2/1971 | Huggins | | |
| 3,635,051 | A | 1/1972 | Betts et al. | | |
| 3,675,246 | A * | 7/1972 | Ito | A41D 1/00 | 2/115 |
| 3,736,597 | A | 6/1973 | Artzt | | |
| 4,095,441 | A | 6/1978 | Robinson et al. | | |
| 4,102,155 | A | 7/1978 | Robinson | | |
| 4,833,732 | A * | 5/1989 | Harmsen | A41D 1/04 | 2/102 |
| 5,479,791 | A * | 1/1996 | Osborne | A41C 3/0014 | 2/73 |
| 5,605,060 | A * | 2/1997 | Osborne | A41C 3/0014 | 2/69 |
| 6,389,850 | B1 * | 5/2002 | Fujiwara | D04B 1/24 | 66/171 |
| 6,453,705 | B2 | 9/2002 | Fujiwara | | |
| 6,550,287 | B1 | 4/2003 | Sherrill | | |
| D598,638 | S | 8/2009 | Graneto | | |
| D674,578 | S | 1/2013 | Glass | | |
| 2001/0042389 | A1 | 11/2001 | Fujiwara | | |
| 2005/0005340 | A1 | 1/2005 | Roux | | |
| 2005/0115281 | A1 | 6/2005 | Mitchell | | |
| 2010/0218298 | A1 | 9/2010 | Stattelmann | | |
| 2015/0284885 | A1 * | 10/2015 | Turner | D04B 1/102 | 66/176 |

OTHER PUBLICATIONS

"File:T-shirt without side-seam.png," Wikimedia Commons, commons.wikimedia.org, Jul. 8, 2013.

International Search Report and Written Opinion dated Jun. 6, 2018 in International Patent Application No. PCT/US2018/019849, 15 pages.

International Preliminary Report on Patentability dated Sep. 12, 2019 in International Patent Application No. PCT/US2018/019849, 9 pages.

Intention to Grant received for European Patent Application No. 18710637.2, dated Jun. 30, 2020, 7 pages.

* cited by examiner

KNIT GARMENT WITH REDUCED SEAMS

CROSS-REFERENCE TO RELATED APPLICATIONS

This application claims the benefit of U.S. Provisional Patent Application No. 62/465,361, filed Mar. 1, 2017, which is hereby incorporated by reference in its entirety.

TECHNICAL FIELD

Aspects herein provide for a knit garment with reduced seams and methods for making a knit garment with reduced seams.

BACKGROUND

Garments typically are made by piecing together two or more separate cuts of fabric. For example, a shirt may be pieced as a front bodice, back bodice, and sleeves, which are joined together at side seams, underarm seams, and shoulder seams. Seams may be troublesome in a shirt for a number of reasons. Seams may be subject to manufacturing defects, including seams which are incomplete or insecure, misplaced, or otherwise fail to create a durable, aesthetically pleasing seam. Seams may add bulk, particularly if the seam joins more than two pieces of fabric, and the bulk may be unattractive or uncomfortable. Seams can also cause chaffing if they rub against the skin, for example, in form-fitting clothes or active wear.

BRIEF DESCRIPTION OF THE DRAWINGS

The present invention is described in detail herein with reference to the attached drawing figures, wherein.

DETAILED DESCRIPTION

Figure 1:
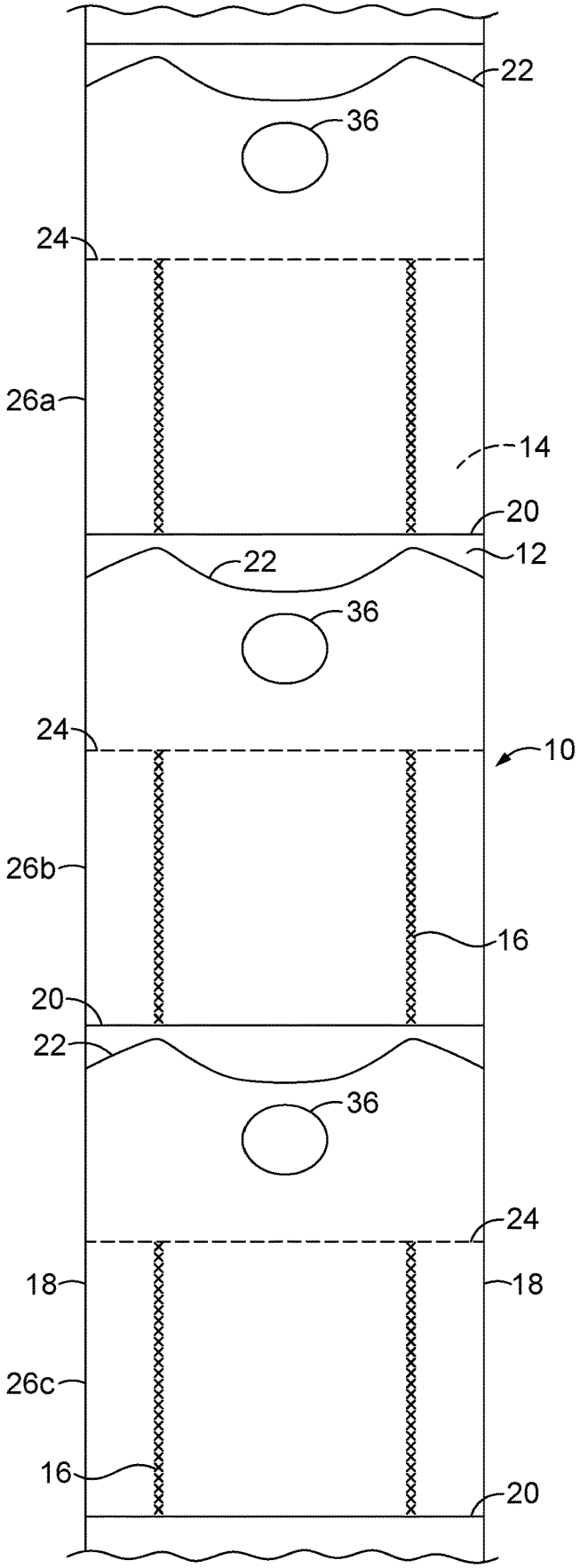
FIG. 1 depicts a continuously knit, double layer web in accordance with an aspect hereof.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects hereof provide for a garment having a single continuous seam along the back of the garment. The garment may be a shirt. The shirt has a seamless, tubular torso section and a shoulder section. The shoulder section is knit continuously with the torso section along a front section of the garment. A single, continuous seam affixes the shoulder section to the torso section across a width of the upper back of the garment.

Aspects hereof provide a method for making a garment. The method includes continuously knitting a double-layer web. The web is defined by at least a first lateral edge and a second lateral edge opposite the first lateral edge. The method includes intermittently interlooping the layers of the web to one another along lines generally parallel to each other and spaced apart from the first and second lateral edges of the web to form a central tube. The web is severed at a first longitudinal boundary of the interlooping, and at a seam line. The seam line is positioned a distance greater than 0 mm from a second longitudinal boundary of the interlooping. The seam line and the first and second longitudinal boundaries are oriented generally perpendicular to the first and second lateral edges. Material is trimmed from at least a first layer of the web along a trim line positioned between the second longitudinal boundary line and the seam line. The second layer is folded over itself, toward the first layer, and the second layer is affixed to the first layer along a seam formed between at least portion of the seam line and at least a portion of the trim line.

The double-layer web can be formed using circular knitting or flat knitting. During the knitting process, a neck hole may be formed in the second layer, positioned between the second longitudinal boundary and the seam line. Alternately or additionally, a neck hole may be cut from a second layer. The neck hole edges may be finished.

The interlooping between the layers of the web may occur in a region of functionally distinctive knitting. The functionally distinctive knitting may include open areas for venting the garment. The first and second lateral edges of the web may be trimmed in a shoulder section, above the trim line, before seaming the second layer to the first layer. After trimming, the shoulder section may have substantially a same width as the torso section. Or the second layer may extend laterally beyond a width of the central tube, forming a lateral overhang. The lateral overhang can be seamed to a portion of the seam line to form sleeves. The lateral edges of the sleeves may be finished.

In another aspect, a garment is disclosed having a seamless tubular torso section formed by interlooping two or more layers of a web. The tubular torso section has a first open end and a second open end opposite the first open end, when the garment is in an unconstructed state. The garment has a shoulder section, integrally formed with a first layer of the tubular torso section and enclosing the second open end of the tubular torso section when the garment is in a constructed state. The shoulder section has a front portion and a back portion. A shoulder seam joins the tubular torso section to the shoulder section along the back portion of the shoulder section. There is a neck hole in the shoulder section. The shoulder seam may arch up toward the neck hole between two sleeves. The garment may have venting along at least a portion of the tubular torso section, the shoulder section, or at least one sleeve extending outwardly from the shoulder section. The tubular torso section may have a mesh knit pattern incorporated along at least two lateral sides of the tubular torso section. The garment may have no seaming along a superior aspect of the shoulder section.

The reduction in seams may result in improved comfort and/or reduced bulk in the garment. The placement of the seam may reduce the potential for chaffing of tender or sensitive skin, such as the skin under the arms.

Positional terms as used herein such as "superior," "top," "bottom," "inferior," "anterior," "posterior," and the like are to be given their common meaning with respect to the apparel item being worn by a hypothetical wearer standing in an upright position. The term "garment" as used in this disclosure refers to an article of clothing, such as a shirt. The form of the shirt may include long-sleeved, ¾-sleeved, short-sleeved, and sleeveless shirts, including tank tops, as well as long shirts, short shirts (or "crop tops"), loose-fitting shirts, body-conforming shirts, and the like. "Garments" also includes, without limitation, apparel typically worn on the upper half of the body, such as jackets, sweaters, vests and nightshirts. As used in this disclosure, terms such as "seaming," "affixing," "coupling," "securing," and the like may mean releasably attaching or permanently attaching two or more elements together. Elements may be releasably attached using, for instance, zippers, sliders, buttons, hooks, snaps, hook-and-loop fasteners, releasable adhesives, and the like. Elements may be permanently attached using, for instance, stitching, bonding, welding, laminates, adhesives, and the like.

Referring now to FIG. 1, an exemplary double-layer, knit web 10 is shown to illustrate the progression of a method for making a garment in accordance with aspects of this disclosure. The underlying or second layer 14 of the double-layer, knit web 10 is not visible in FIG. 1, however, the web 10 comprises a first layer 12 and a second layer 14. The web 10 can be knit using any desired process, including flat knit, circular knit, knitting with individually driven needles, knitting with bar needles, hand knitting, or a combination thereof. Moreover, the double-layer web 10 may be warp knit or weft knit. The first and second layer 12, 14 may be knit continuously with one another (e.g., as a tube), or may be knit as separable pieces that are arranged on top of one another, or may be joined at one or both lateral edges 18 of the web 10. The web 10 may be a single, continuous knit material folded over onto itself to give a double-layer thickness, or may be joined at both lateral edges such that the layers could be spaced apart from one another to form an open tube. The lateral edges 18 of web 10 may be approximately parallel to one another, recognizing that acceptable process variation will often result in some deviance from perfect parallel.

Layers 12, 14 may be interlooped to one another along interlooping lines 16, which run generally parallel to one another and at or within the lateral edges 18 of web 10. For instance, interlooping lines 16 may run a non-zero distance from lateral edges 18 of web 10. Or interlooping lines 16 may be spaced apart from the lateral edges 18 of web 10 by a predetermined distance. The interloops along interlooping lines 16 join the knit of layer 12 to the knit of layer 14. This interlooping may be accomplished using, for example, a Kitchener stitch or equivalent, and may result in the appearance of a continuous, seamless central tube in torso section 44 (shown in FIG. 3). One of skill in the art will appreciate that a Kitchener stitch or its functional equivalent can be produced using knitting needles and need not involve a separate, post-knitting seaming process. Interlooping lines 16 need not be exactly parallel to one another, and a variation of up to and including 20° from parallel may be desirable, for example, to allow for broader shoulders or a narrower waist in the garment. Interlooping lines 16 are marked as "x"s in the figures to draw attention to the interlooping, so as to better visualize the location of the interlooping lines 16. However, in reality the interlooping might be unnoticeable in the web 10, at least without careful inspection.

Figure 4:
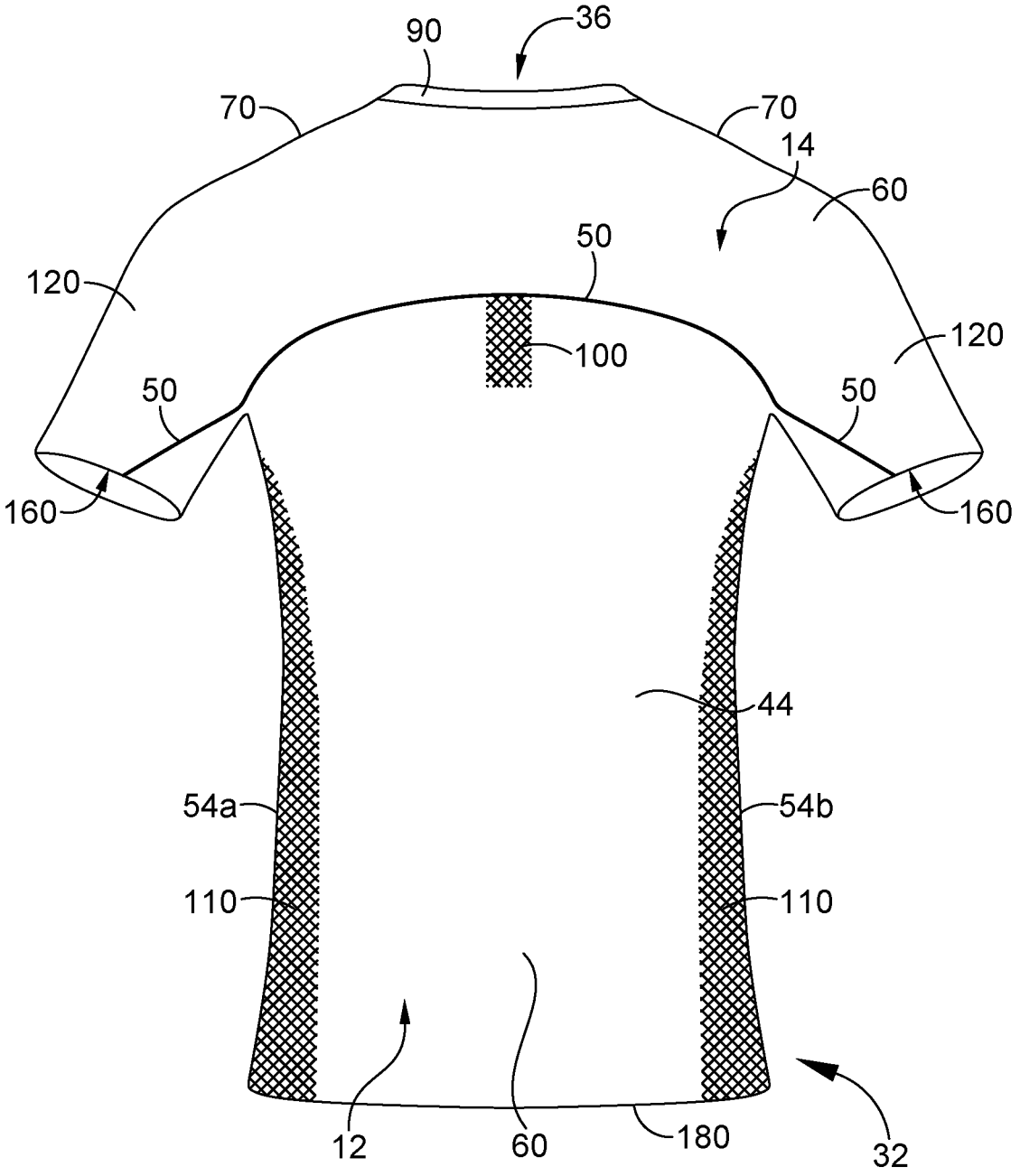
FIG. 4 depicts a back of a garment in accordance with an aspect hereof.
Figure 6:
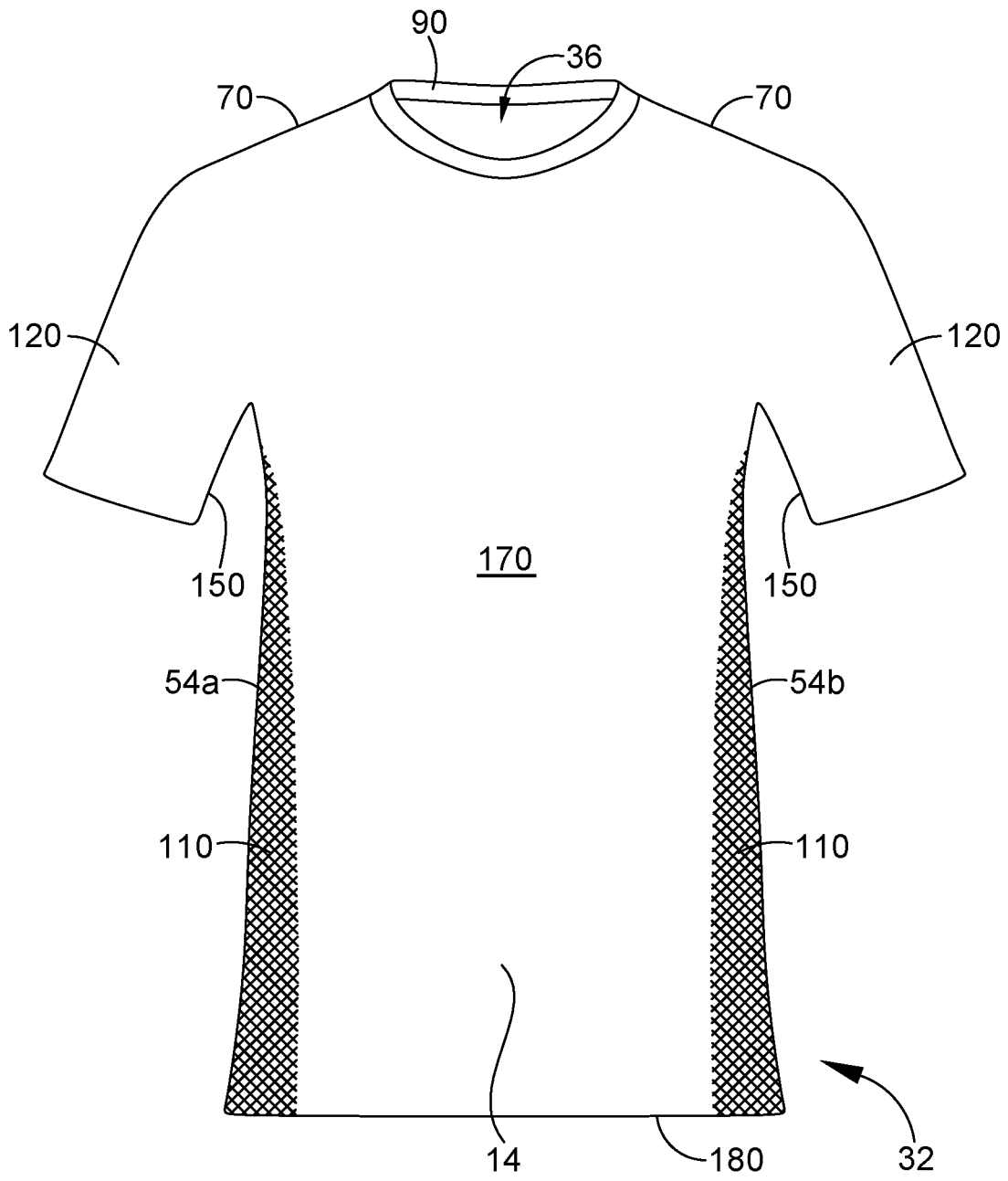
FIG. 6 depicts a front of a garment in accordance with an aspect hereof.

The web 10 may be severed or cut at or near a first longitudinal boundary 20 of the interlooping lines 16, where the first longitudinal boundary 20 may be oriented perpendicular or near perpendicular the interlooping lines 16. The first longitudinal boundary 20 may form or be used to form (e.g., by hemming or other finishing) the bottom edge 180 of the torso section 44 of the garment 32 as shown in FIGS. 4 and 6. With continued reference to FIGS. 4 and 6, if the first longitudinal boundary 20 is distanced (e.g., a non-zero distance) from the ends of interlooping lines 16, the unfinished bottom edge 180 of garment 32 may have open flaps at lateral edges 54*a*, 54*b*, where the first and second layers 12, 14 are not joined to each other. In another example, first longitudinal boundary 20 may be placed over or intersecting with interlooping lines 16. If the knit is made such that cutting into interlooping lines 16 will not risk unraveling the knit, or if the bottom edge 180 is finished promptly, placing first longitudinal boundary 20 over interlooping lines 16 is a way to shorten the length of garment 32. As shown, first longitudinal boundary 20 is placed at an end point of each of interlooping lines 16.

With reference again to FIG. 1, the web 10 may be severed or cut at a seam line 22. The seam line 22 may be positioned a distance greater than 0 mm from a second longitudinal boundary 24 of the interlooping lines 16, where the second longitudinal boundary 24 is oriented perpendicular or near perpendicular to the interlooping lines 16. The second longitudinal boundary 24 is shown in dashed lines because it need not be a real line, e.g., marked or distinctly visible in the web 10 or garment 32, but may be a useful reference line for discussion or measurement. The distance between the second longitudinal boundary 24 and the seam line 22 may be selected based on the desired length of the shoulder section 42. Severing the web 10 at the first longitudinal boundary 20 and the seam line 22 divides the web 10 into one or more web portions 26 *a*, 26 *b*, and 26 *c* that will be further processed to form a garment blank 56 as shown in FIG. 3.

Figure 2:
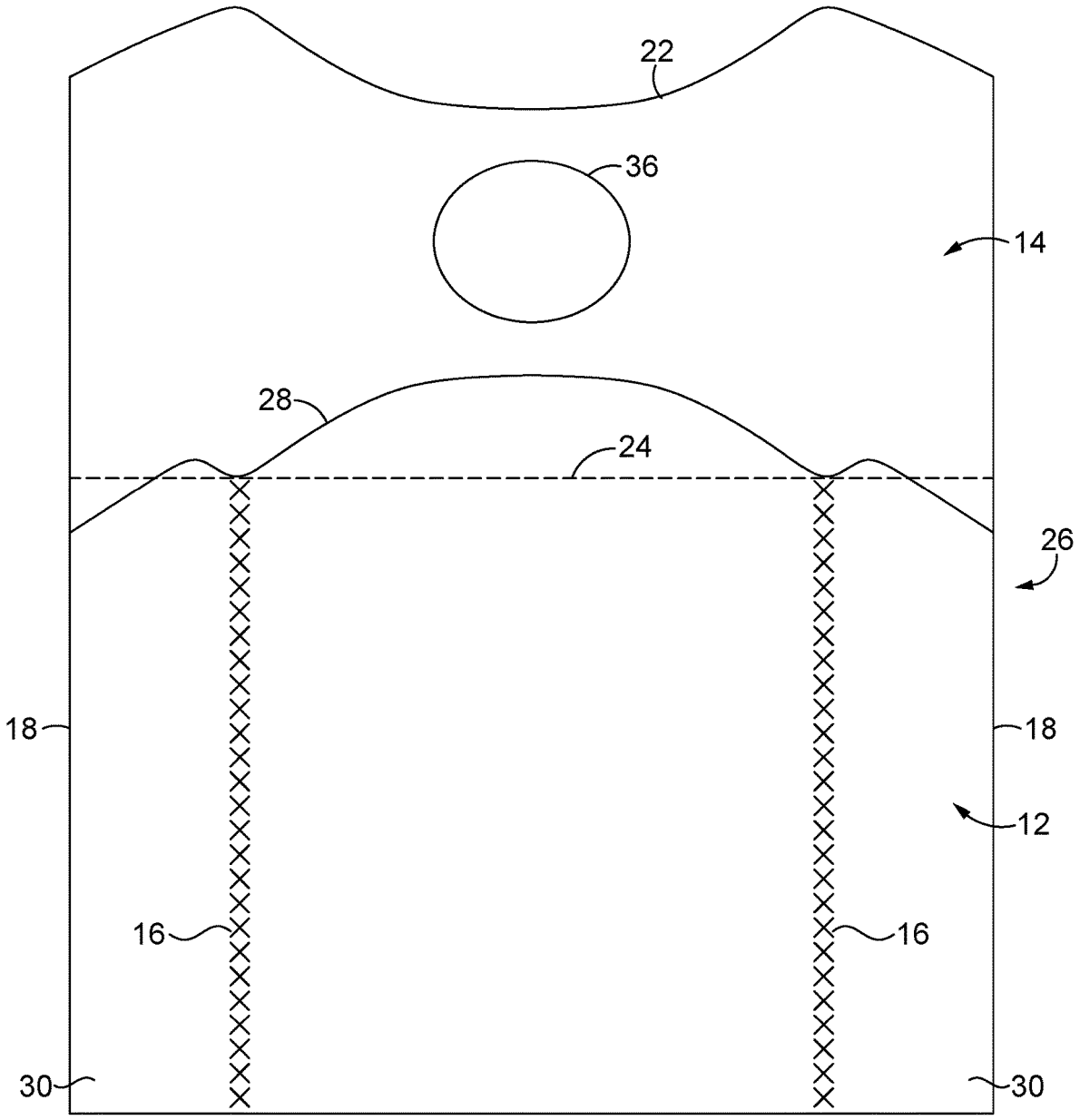
FIG. 2 depicts a blank for a garment cut from the web of FIG. 1 in accordance with an aspect hereof.

In FIG. 2, which represents one of the web portions 26*a*, 26*b*, or 26*c* (now known as web portion 26), a portion of the first layer 12 of web 10 has been trimmed away along a trim line 28, exposing second layer 14. Discard flaps 30 are trimmed away along trim line 28 and interlooping lines 16. This trimming reveals the seamless, tubular torso section 44 of the garment 32. In some aspects, a method for making a garment may involve trimming web portion 26 after it has been severed from web 10. In other aspects, web portion 26 may be trimmed before it is severed from web 10, or simultaneously with being severed from web 10. Similarly, neck hole 36 may be knit into web portion 26, e.g., by modifying the knitting process to leave a hole in the web 10, or neck hole 36 may be cut from web portion 26, before, after, or during the severance of web portion 26 from web 10. Other trimming and cutting operations may similarly be ordered or coordinated as desired.

Figure 3:
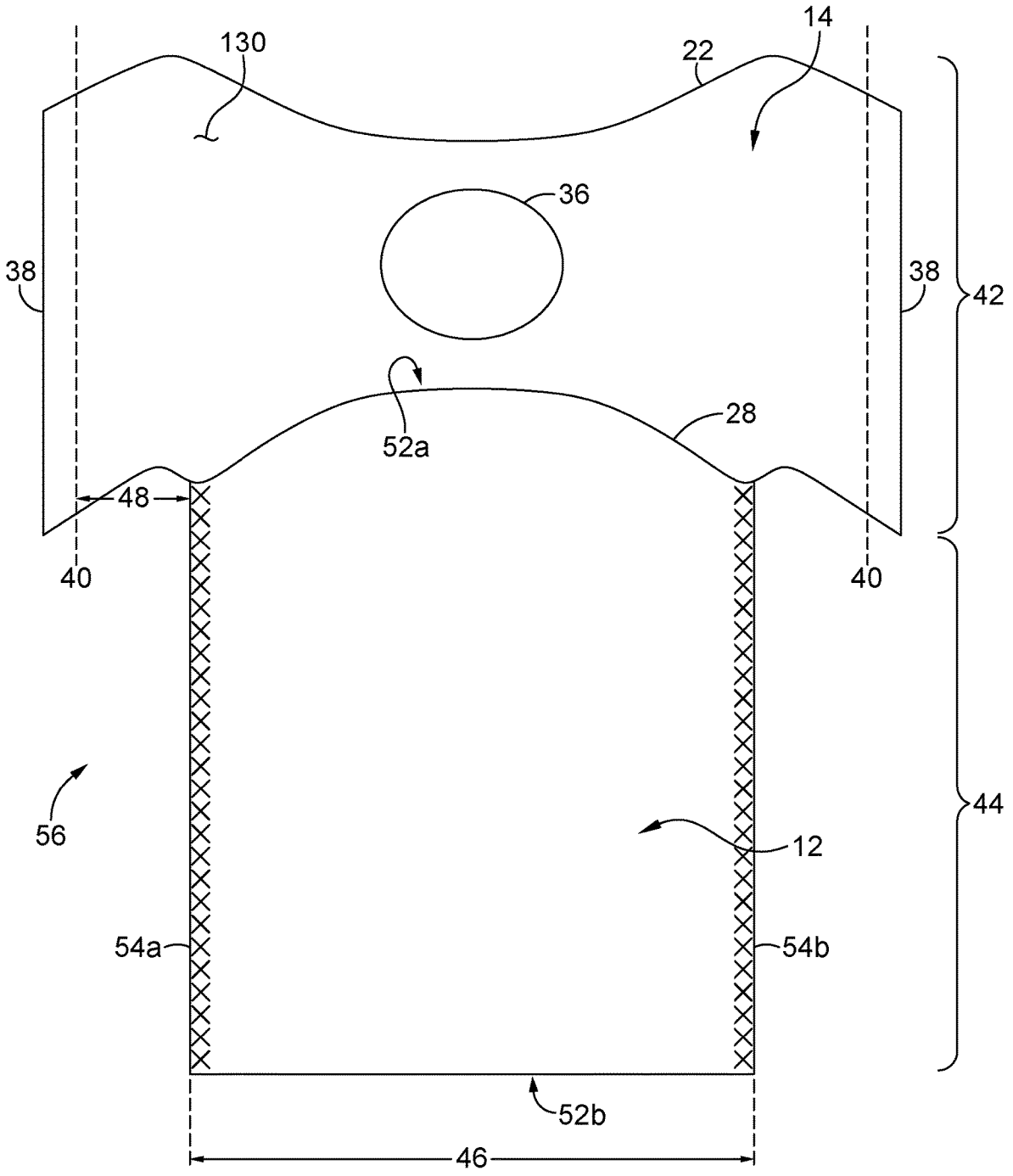
FIG. 3 depicts a trimmed blank for a garment in accordance with an aspect hereof.

Trimming away discard flaps 30 yields a garment blank 56, as shown in FIG. 3. As shown, the garment blank 56 has a shoulder section 42 and a seamless tubular torso section 44. The seamless tubular torso section 44, in this unconstructed state, has open ends 52*a*, 52*b*, a width 46, and lateral edges 54*a*, 54*b*. In a constructed state (as shown, for example, in FIG. 4) the shoulder section 42 encloses one open end 52*a* of the torso section 44. Shoulder section 42 has shoulder lateral edges 38. If desired, shoulder lateral edges 38 may be trimmed, for example, at sleeve trim line 40. If trimmed at line 40, the shoulder lateral edges would have a lateral overhang 48 beyond the width 46 of torso section 44. The lateral overhang 48 can be seamed to a corresponding portion of seam line 22 to form sleeves 120 in garment 32 (see FIG. 4). Sleeve trim line 40 may occur anywhere inward of shoulder lateral edges 38, including possibly within an imaginary extension of a line along lateral edge 54*a* or 54*b* into shoulder section 42. That is, the "sleeves" may be untrimmed, extending to shoulder lateral edges 38, or may be trimmed to shorten the overhang (and therefore shorten the sleeves), or may be trimmed to be substantially the same as (for example, within plus or minus 15%) of the width 46 of torso section 44 (to produce a sleeveless shirt), or may be trimmed inward of the width 46 of torso section 44 to produce a tank top, halter top, or other armhole style that curves inward. Lateral overhang 48 is shown as symmetric, but could be asymmetric if desired. Any and all aspects, and any variation thereof, are contemplated as being within aspects herein.

Figure 5:
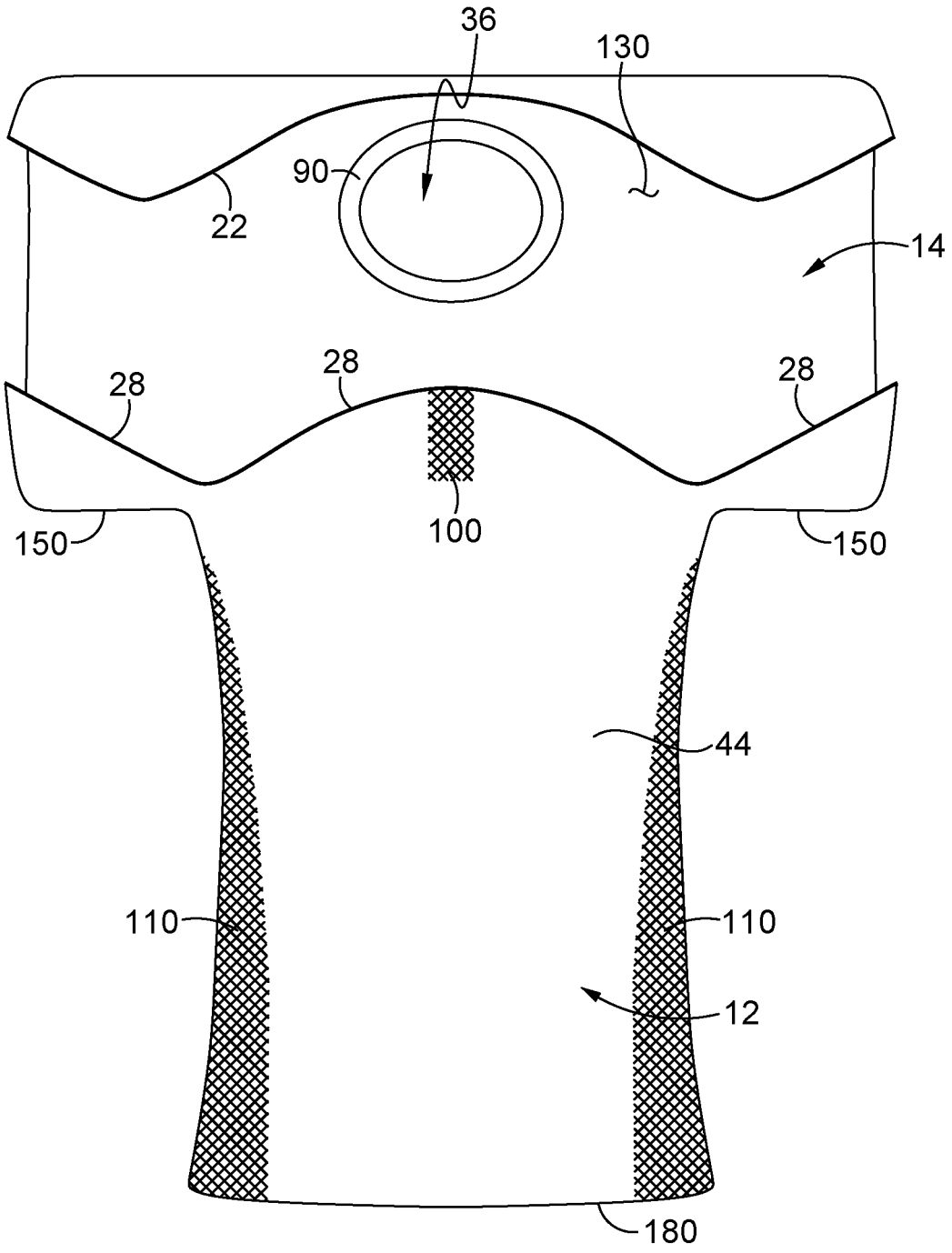
FIG. 5 depicts a back of a partially constructed garment blank in accordance with an aspect hereof.

To finish the garment 32, an upper surface 130 of layer 14, is folded over itself and toward first layer 12, shown partially folded over in FIG. 5. A portion of the lateral overhang 48 along trim line 28 may be folded over itself and toward second layer 14, as is also shown in FIG. 5. The trim line 28 is then affixed to seam line 22 using any desired fastener or joining process, including, without limitation, sewing, gluing (with adhesives or cohesives), welding (heat, ultrasound or other), and combinations thereof. If desired, temporary or refastenable systems could be used, including, without limitation, buttons, zippers, hook-and-loop systems, hook-and-eye systems, snaps, laces, and combinations thereof. Combinations of permanent and refastenable joints are also possible.

Trim line 28 need not be affixed to seam line 22 along the entire length of trim line 28 and/or seam line 22. For example, gaps may be left in the seam for aesthetic reasons, or to permit the transfer of heat, air, and/or moisture. The lateral overhang 48 may be affixed to a corresponding portion of seam line 22 as a continuation of seam 50 to form sleeves 120, terminating in armhole edges 160, as shown in FIG. 4. That is, sleeves 120 may be formed using the same single, continuous seam 50 that forms the garment 32. The term, "single, continuous seam" as used herein may mean a seam formed through a single seaming event. For example, a single seaming event may comprise a stitching event where the stitching needle remains in contact with the garment throughout the stitching event. This is in contrast to seaming discontinuous seams where the seaming event may comprise multiple separate instances of forming the different disparate seams. Continuing, no seaming is necessary along a superior aspect 70 of shoulder section 42. In some aspects, no seaming is present along a superior aspect 70 of the shoulder section 42, an inferior aspect 150 of sleeves 120, or both. In some aspects, seam 50 is the only seam in the garment. In some aspects, seam 50 is a single, continuous seam, and is the only seam in the garment.

Seam 50 may be linear, or curvilinear, or irregular, and may be symmetric or asymmetric about an axis running length-wise (i.e., parallel to lateral edges 18) down the center of the garment. In some embodiments, seam 50 may arch upward toward neck hole 36 between lateral edges 54*a* and 54*b* as shown in FIG. 4. In some embodiments, seam 50 may turn upward or superiorly as it approaches armhole edges 160. Neck hole 36 is depicted in the figures as round, however, neck hole 36 may be of any desired shape, including, without limitation, slit, v-neck, square neck, boat neck, off-the-shoulder, one-shoulder, halter, keyhole, and the like.

FIG. 4 depicts the back portion 60 of a garment 32, which is shown as a short-sleeved shirt. Tubular torso section 44, defined laterally by lateral side edges 54*a*, 54*b* and at the top of the tube along seam 50, may optionally have regions 100 and 110 of functionally distinctive knitting pattern. Region 100 is placed approximately centrally between lateral side edges 54*a* and 54*b*, extending downward from seam 50. As shown, region 100 extends perhaps a few inches. However, region 100 could be narrower, wider, longer or shorter than shown. The region 100 may be defined by a modification in the knit pattern in region 100. For example, region 100 may involve looser or less dense knit than neighboring sections of knit, such as a mesh knit. Region 100 may be modified, as by puncturing, stretching, coating, chemical treatment, or otherwise, to change the function of region 100. For example, region 100 may be more air-, heat- and/or moisture-permeable than neighboring sections of knit. Regions 110 are shown as symmetric regions on each lateral side 54*a*, 54*b* of torso section 44, and may be present with or without the presence of region 100. Additional regions of functionally distinctive knitting may be provided, for example, in other areas of the torso section 44, in the shoulder section 42, and/or in one or both of the sleeves 120. If two or more regions of functionally distinctive knitting are provided, they may be of the same or different structures or modifications.

In some aspects the edges of the garment 32 are knit in a manner that allows them to be cut-to-finish. For example, warp knitting will not unravel when cut and, for some materials and knitting patterns, may provide a suitable finished edge with no further processing after trimming. Alternately, bottom edge 180, armhole edges 160, and/or neck hole 36 may be finished, as by hemming the edge (via any securement mechanism, including those described above, such as sewing, welding, gluing, buttons, etc.), serging, overlock, embroidery, the addition of a separate finishing band or material (such as neckband 90 or a collar, not shown), or combinations thereof. If one or more of bottom edge 180, armhole edges 160, and/or neck hole 36 is finished, the other edges may be finished or unfinished, and, if finished, may be finished in the same manner or in a different manner. As noted above, neck hole 36 may be knit into the fabric (or, from a different perspective, the web may be knit around neck hole 36). If neck hole 36 is formed during the knitting process, neckband 90 may also be formed during the knitting process, and may comprise the same or a different pattern, thickness, or tightness of knit than the surrounding knit material. That is, neckband 90 may be distinguishable from the remainder of layer 14 (if it is distinguishable from the remainder of layer 14) because of a localized knitting pattern, rather than because neckband 90 is added separately to garment 32. When neckband 90 is integrally formed in the shoulder section 42, no seaming is required to join neckband 90 to garment 32.

FIG. 6 depicts a front portion 170 of garment 32, shown as a shirt. Regions 110 may be placed such that they are visible from the front of garment 32. As shown, there are no seams in the front portion 170 of the shirt, and, in particular, no seams are present along a superior aspect 70 of shoulder section 42 and/or an inferior aspect 150 of sleeves 120. In some embodiments, the only seam visible from front portion 170 of garment 32 is a seam joining optional neckband 90 to the edge of neck hole 36.

Garment 32 may be knitted from any desired material, including natural fibers, synthetic fibers, and combinations thereof. Suitable materials may include polyester, elastane (commonly referred to by its tradename, LYCRA), cotton, wool, silk, rayon, nylon, acrylic, modified versions of these fibers, and combinations of these fibers, to include coated or co-extruded fibers. Functional fabrics made by material selection and/or modified knitting patterns are known and may be used for the entire garment 32 or portions thereof, such as regions 100, 110. Exemplary functional fabrics, including fabrics that can change breathability (transmission of air, heat and/or moisture) under different environmental conditions, are described in U.S. Patent Publication 2005/0204449.

Figure 7:
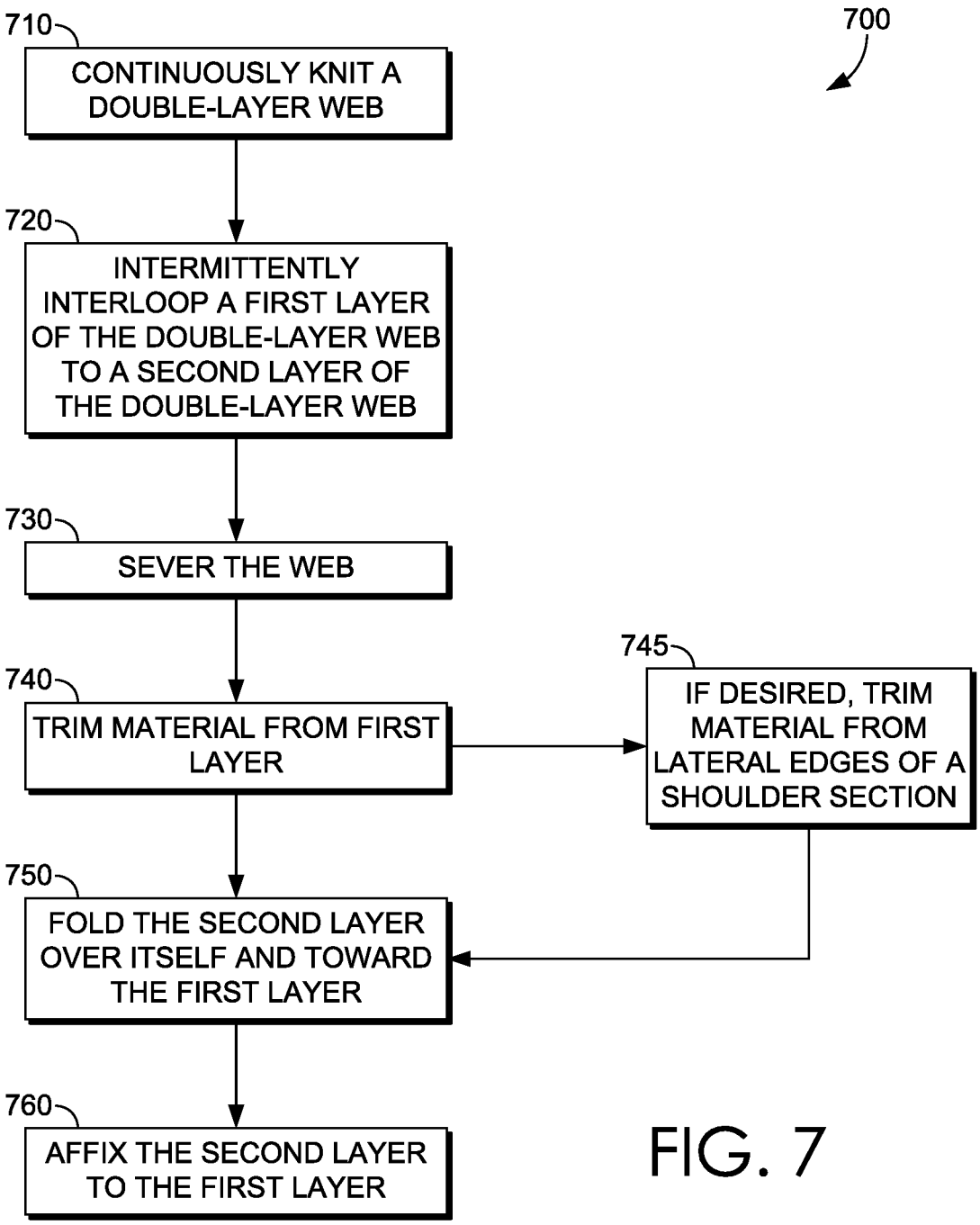
FIG. 7 provides a flow chart for a method of making a garment in accordance with an aspect hereof.

FIG. 7 depicts a simplified flowchart for a method 700 for making a garment in accordance with an aspect of this disclosure. At step 710, a double-layer web 10 is continuously knit. At step 720, a first layer 12 of the double-layer web 10 is intermittently interlooped to a second layer 14 of the double-layer web 10. At step 730, the web 10 is severed, as into web portions 26*a*, 26*b* and 26*c*. At step 740, material is trimmed from at least the first layer 12 of the web 10. If desired, material may be trimmed from lateral edges 38 of a shoulder section 42, at step 745. At step 750, the second layer 14 is folded over itself and toward the first layer 12. At step 760, the second layer 14 is affixed to the first layer 12, for example, along a seam 50 formed between at least a portion of a seam line 22 and a trim line 28. Exemplary variations of the method shown in FIG. 7 are described above.

Unless otherwise noted, a garment according to aspects of this disclosure may be further processed or embellished, and in particular may be supplemented with additional parts, such as collars, cuffs, decoration (including, without limitation, decorative and/or functional fasteners, sequins, glitter, paint or printing, rhinestones, ribbons, other trim or notions, and combinations thereof). Such additions may involve additional seaming, and any additions may be affixed in locations or affixed using methods to avoid seams under the arms, along the sides of the torso (e.g., along the torso, generally under the arms), or on the superior aspect of the shoulders.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A method for making a garment, the method comprising:

continuously knitting a double-layer web defined by at least a first lateral edge and a second lateral edge opposite the first lateral edge, the double-layer web comprising a first layer and a second layer;

intermittently interlooping layers of the double-layer web to one another to form a first interlooping line spaced apart from the first lateral edge and a second interlooping line spaced apart from the second lateral edge of the double-layer web to form a tubular torso section;

severing the double-layer web at a first longitudinal boundary of the double-layer web, and at a seam line, the seam line positioned a distance greater than 0 mm from the first longitudinal boundary of the double-layer web;

cutting off only the first layer of a shoulder section from the double-layer web to expose the second layer of the shoulder section, wherein cutting off only the first layer comprises cutting along a trim line positioned between the first longitudinal boundary and the seam line, wherein the trim line extends from the first lateral edge to the second lateral edge;

folding the second layer of the shoulder section over itself and toward the first layer; and affixing the second layer of the shoulder section to the first layer of the tubular torso section along a seam formed between at least a portion of the seam line and at least a portion of the trim line.

2. The method of claim 1, wherein the double-layer web is formed by circular knitting.

3. The method of claim 1, wherein the double-layer web is formed by flat knitting.

4. The method of claim 1, further comprising forming a neck hole in the second layer, the neck hole positioned between the trim line and the seam line.

5. The method of claim 1, further comprising cutting a neck hole from the second layer, the neck hole positioned between the trim line and the seam line.

6. The method of claim 5, further comprising finishing an edge of the neck hole.

7. The method of claim 1, wherein each of the first interlooping line and the second interlooping line extend from the first longitudinal boundary to the trim line.

8. The method of claim 7, wherein each of the first interlooping line and the second interlooping line are disposed in a region of the double-layer web that comprises open areas for venting the garment.

9. The method of claim 1, wherein the seam line is curvilinear.

10. The method of claim 1, further comprising trimming the first lateral edge and the second lateral edge of the double-layer web in the shoulder section above the trim line before affixing the second layer to the first layer.

11. The method of claim 10, wherein after trimming the first lateral edge and the second lateral edge of the double-layer web in the shoulder section, the shoulder section has a same width as the tubular torso section.

12. The method of claim 1, wherein the second layer extends laterally beyond a width of the tubular torso section, forming a lateral overhang.

13. The method of claim 12, wherein the lateral overhang is seamed to a portion of the seam line to form one or more sleeves.

14. The method of claim 13, wherein each sleeve of the one or more sleeves comprises an armhole edge, and wherein the method further comprises finishing the armhole edge.

* * * * *